US005931107A

United States Patent [19]

Thrash et al.

[11] Patent Number: 5,931,107

[45] Date of Patent: Aug. 3, 1999

[54] ADVANCED STITCHING HEAD FOR MAKING STITCHES IN A TEXTILE ARTICLE HAVING VARIABLE THICKNESS

[75] Inventors: Patrick J. Thrash, Huntington Beach; Jeffrey L. Miller, Hermosa Beach, both of Calif.; Richard Codos, Warren, N.J.

[73] Assignee: McDonnell Douglas Corporation, St. Louis, Mo.

[21] Appl. No.: 08/996,412

[22] Filed: Dec. 22, 1997

[51] Int. Cl.[6] ..... D05B 19/12; D05B 47/00

[52] U.S. Cl. ..... 112/470.05; 112/254; 112/281; 112/302

[58] Field of Search ..... 112/470.05, 470.01, 112/254, 255, 300, 302, 470.12, 470.13, 280, 475.02, 281, 270

[56] References Cited

U.S. PATENT DOCUMENTS

| | | | |
|---|---|---|---|
| 3,312,184 | 4/1967 | Cash | 112/118 |
| 3,515,080 | 6/1970 | Ramsey | 112/121.14 |
| 4,067,276 | 1/1978 | Mohilo et al. | 112/220 |
| 4,092,938 | 6/1978 | Coughenour | 112/158 |
| 4,104,976 | 8/1978 | Landau, Jr. | 112/158 |
| 4,285,293 | 8/1981 | Martling | 112/281 |
| 4,301,757 | 11/1981 | Tonomura | 112/254 |
| 4,331,091 | 5/1982 | Parker et al. | 112/262.1 |
| 4,408,554 | 10/1983 | Takiguchi et al. | 112/302 |
| 4,429,364 | 1/1984 | Maruyama et al. | 364/400 |
| 4,446,520 | 5/1984 | Shigeta et al. | 364/400 |
| 4,481,507 | 11/1984 | Takuguchi et al. | 340/679 |
| 4,503,788 | 3/1985 | Giannuzzi et al. | 112/121.12 |
| 4,506,611 | 3/1985 | Parker et al. | 112/79 |
| 4,633,794 | 1/1987 | Kato | 112/270 |
| 4,776,291 | 10/1988 | Tajima et al. | 112/98 |
| 4,786,343 | 11/1988 | Hertzbert | 156/93 |
| 4,793,273 | 12/1988 | Hara et al. | 112/278 X |
| 4,798,152 | 1/1989 | Simons et al. | 112/262.1 |
| 4,815,404 | 3/1989 | Ellermann et al. | 112/121.11 |
| 4,843,986 | 7/1989 | Kozuka et al. | 112/163 |
| 4,873,931 | 10/1989 | Takagi et al. | 112/121.11 |
| 4,876,973 | 10/1989 | Marrache et al. | 112/121.16 |
| 4,899,287 | 2/1990 | Hulshoff et al. | 364/470 |
| 4,917,756 | 4/1990 | Cahuzac et al. | 156/429 |
| 4,992,317 | 2/1991 | Chess et al. | 428/102 |
| 5,042,408 | 8/1991 | Suzuki | 112/300 X |
| 5,138,961 | 8/1992 | Nakano et al. | 112/302 X |
| 5,218,916 | 6/1993 | Kurono et al. | 112/121.12 |
| 5,239,475 | 8/1993 | Shigeta et al. | 364/470 |
| 5,287,820 | 2/1994 | Stutznacker | 112/117 |
| 5,299,519 | 4/1994 | Hirabayashi | 112/456 |
| 5,341,755 | 8/1994 | Kawasaki | 112/163 |
| 5,379,226 | 1/1995 | Shigeta | 364/470 |
| 5,383,417 | 1/1995 | Norrid | 112/278 |
| 5,392,724 | 2/1995 | Kurono et al. | 112/121.12 |
| 5,473,535 | 12/1995 | Shigeta et al. | 364/191 |
| 5,474,001 | 12/1995 | Tajima et al. | 112/102.5 |
| 5,510,994 | 4/1996 | Tsonis et al. | 364/470 |
| 5,515,798 | 5/1996 | Cahuzac | 112/470.12 |
| 5,537,945 | 7/1996 | Sugihara et al. | 112/470.06 |
| 5,543,005 | 8/1996 | Monget et al. | 156/93 |

*Primary Examiner*—Peter Nerbun
*Attorney, Agent, or Firm*—Westerlund & Powell, P.C.; Robert A. Westerlund; Raymond H.J. Powell, Jr.

[57] ABSTRACT

A stitching head for a computer numerically controlled stitching machine includes a thread tensioning mechanism for automatically adjusting thread tension according to the thickness of the material being stitched. The stitching head also includes a mechanism for automatically adjusting thread path geometry according to the thickness of the material being stitched.

20 Claims, 7 Drawing Sheets

ADVANCED STITCHING HEAD FOR MAKING STITCHES IN A TEXTILE ARTICLE HAVING VARIABLE THICKNESS

This invention was made under contract no. NAS1-18862 awarded by NASA. The Government has certain rights in this invention.

BACKGROUND OF THE INVENTION

This invention relates to textile manufacturing. More specifically, this invention relates to a stitching head for a stitching machine that is computer numerically controlled.

Large aircraft structures such as wing covers are now being fabricated from textile composites. The textile composites are attractive because of their potential for lowering the cost of fabricating the large aircraft structures. Cutting pieces of fabric and stitching the fabric pieces together have the potential of being less expensive then cutting sheets of aluminum, drilling holes in the aluminum sheets, removing excess metal and assembling metal fasteners.

The wing cover can be made from a carbon-fiber textile composite. Sheets of knitted carbon-fiber fabric are cut out into pieces having specified sizes and shapes. Fabric pieces having the size and shape of a wing are laid out first. Several of these pieces are stacked to form the wing cover. Additional pieces are stacked to provide added strength in high stress areas. After the fabric pieces are arranged in their proper positions, the pieces are stitched together to form a wing preform. Secondary details such as spar caps, stringers and intercostals are then stitched onto the wing preform. Such a wing preform might have a thickness varying between 0.05 inches and 1.5 inches. The wing preform is quite large, and its surface is very complex, usually a compound contoured three-dimensional surface.

The stitched wing preform is transferred to an outer mold line tool that has the shape of an aircraft wing. Prior to the transfer, a surface of the outer mold line tool is covered with a congealed epoxy-resin. The tool and the stitched wing preform are placed in an autoclave. Under high pressure and temperature, the resin is infused into the stitched preform and cured. Resulting is a cured wing cover that is ready for assembly into a final wing structure.

For textile composite technology to be successful, two barriers must be addressed: cost and damage tolerance. Damage tolerance is achieved by making high quality, closely-spaced stitches on the wing preform. The high quality, closely-spaced stitches add a third continuous column of material to the wing preform. If thread tension is not proper, a large number of stitches on the preform will not be of sufficient quality and will reduce the damage tolerance. Improper thread path geometry might also degrade the quality of the stitches and, therefore, reduce the damage tolerance.

Even though the stitches are made by a stitching machine that is computer numerically controlled ("CNC"), it is difficult to make stitches having the high quality required for the wing preform. On a compound, contoured three-dimensional surface, thread tension and thread path geometry must be constantly adjusted for an exceedingly large number of stitches. The CNC stitching machine might make eight to ten stitches per inch, in rows that might be spaced 0.1 inches to 0.5 inches apart, over a surface that might be longer than forty feet and wider than eight feet. The total number of stitching points on the wing preform might exceed 1.5 million.

Much manual operation is required. Because the wing preform has many regions of differing thickness, a machine operator must constantly stop the stitching machine when a new region is about to be stitched, adjust the thread tension and possibly the thread path geometry, and restart the stitching machine. Of course, the CNC stitching machine has multiple stitching heads. At any given time, two or more stitching heads might be stitching different regions having different thicknesses. Whenever one of the stitching heads enters a new region, the stitching machine must be stopped and the thread tension and perhaps the thread path geometry of the stitching head entering the new region must be adjusted. Resulting is a large number of instances in which the stitching machine must be stopped, the thread tension and thread path geometry adjusted, and the stitching machine restarted.

Moreover, the operator must know when to stop the machine and make the adjustments, or the operator must be prompted to stop the stitching machine and make the adjustments. Either way, the operator must pay constant attention while the wing preform is being stitched. That too is difficult, considering the large number of stitches that must be made.

The operator might be required to perform additional functions while the wing preform is being stitched. Additional functions might include cutting needle thread and turning on and off needle cooling when a stitching head enters a region of different thickness.

The manual operation increases the time and cost of manufacturing the wing preform, and it potentially reduces damage tolerance. Based on the foregoing, it can be appreciated that there presently exists a need for faster, more efficient, and more precise apparatus for stitching preforms having variable thickness. As will become apparent hereinafter, the present invention fulfills this need.

SUMMARY OF THE INVENTION

The invention can be regarded as a stitching system comprising a stitching machine including a stitching head. The stitching head includes a thread tensioning mechanism. The thread tensioning mechanism includes a servo for setting thread tension in the stitching head. The stitching system further comprises a control station including a computer. The computer includes computer memory encoded with data for instructing the computer to command the servo to set the thread tension in the stitching head to desired thread tension values. Thus, setting the thread tension is data-driven.

The invention can also be regarded as apparatus for automatically adjusting thread tension in a stitching head. The apparatus comprises a thread tensioning mechanism including a servo, the servo setting the thread tension in response to servo commands; a processor; and computer memory encoded with data including instructions for instructing the computer to generate thread tension commands based on desired thread tension values. The servo commands are generated from the thread tension command and supplied to the servo.

The invention can also be regarded as a stitching head for stitching a preform made of multiple layers of a variable thickness textile composite. The stitching is performed with a thread made of a composite material. The stitching head comprises a needle; means for reciprocating the needle; a servo-driven thread gripper; a servo-driven thread cutter; and a servo-driven thread path geometry control for adjusting an amount of the thread used by the needle during the stitching of the preform. Adjustment of the amount of thread used during the stitching is based upon thickness of the preform.

BRIEF DESCRIPTION OF THE DRAWINGS

The above and other objects, features and advantages of the present invention will become apparent from the following detailed description taken in conjunction with the accompanying drawings, in which.

DETAILED DESCRIPTION OF THE INVENTION

While the present invention is described herein with reference to the illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
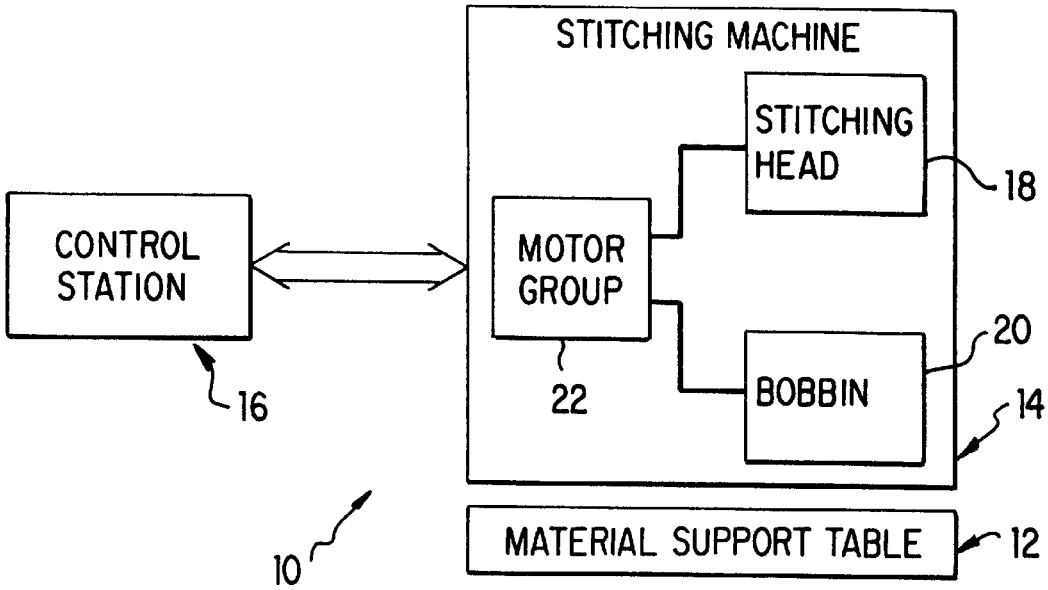
FIG. 1 is a block diagram of a stitching system including a stitching machine and a control station.

FIG. 1 shows an automated stitching system 10 including a material support table 12, a stitching machine 14 and a control station 16. The material support table 12 provides a surface for supporting a preform. The surface of the material support table 12 can be tailored to the desired shape of the preform. For example, the material support table 12 can provide a flat two-dimensional surface, a contoured three-dimensional surface, or a compound, contoured three-dimensional surface.

The stitching machine 14 includes a stitching head 18 and bobbin 20 operable to make a plurality of stitches in the preform. The stitching machine 14 further includes a motor group 22 for moving the stitching head 18 and the bobbin 20 with respect to the material support table 12. The motor group 22 includes a first servo-controlled motor for positioning the stitching head 18 with respect to an x-axis and a second servo-controlled motor for positioning the stitching head 18 with respect to a y-axis. The motor group 22 could also include a third servo-controlled motor for positioning the stitching head 18 with respect to a z-axis and a fourth servo-controlled motor for positioning the stitching head 18 with respect to a rotational c-axis. The third and fourth servo-controlled motors would allow the stitching machine 14 to stitch a preform having a compound, contoured three-dimensional surface. The motor group 22 also includes servo-controlled motors for moving the bobbin 20 synchronously with the stitching head 18. Of course, the motor group 22 could include additional servo-controlled motors if additional degrees of freedom are desired.

Figure 2:
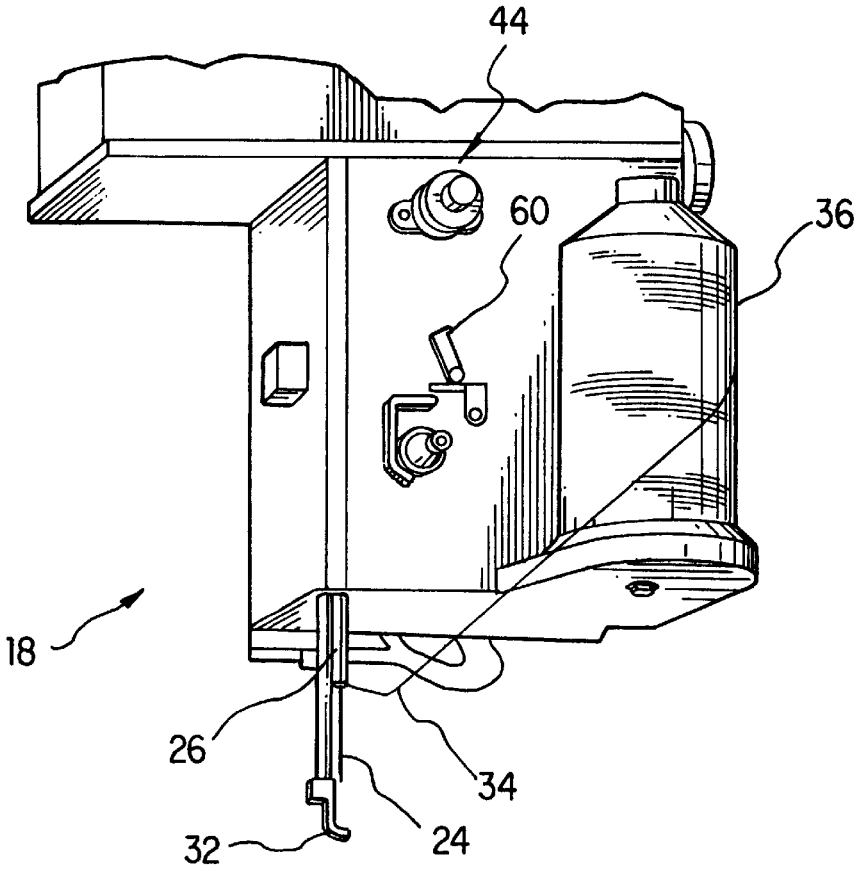
FIG. 2 is a perspective view of a stitching head for the stitching machine.
Figure 3:
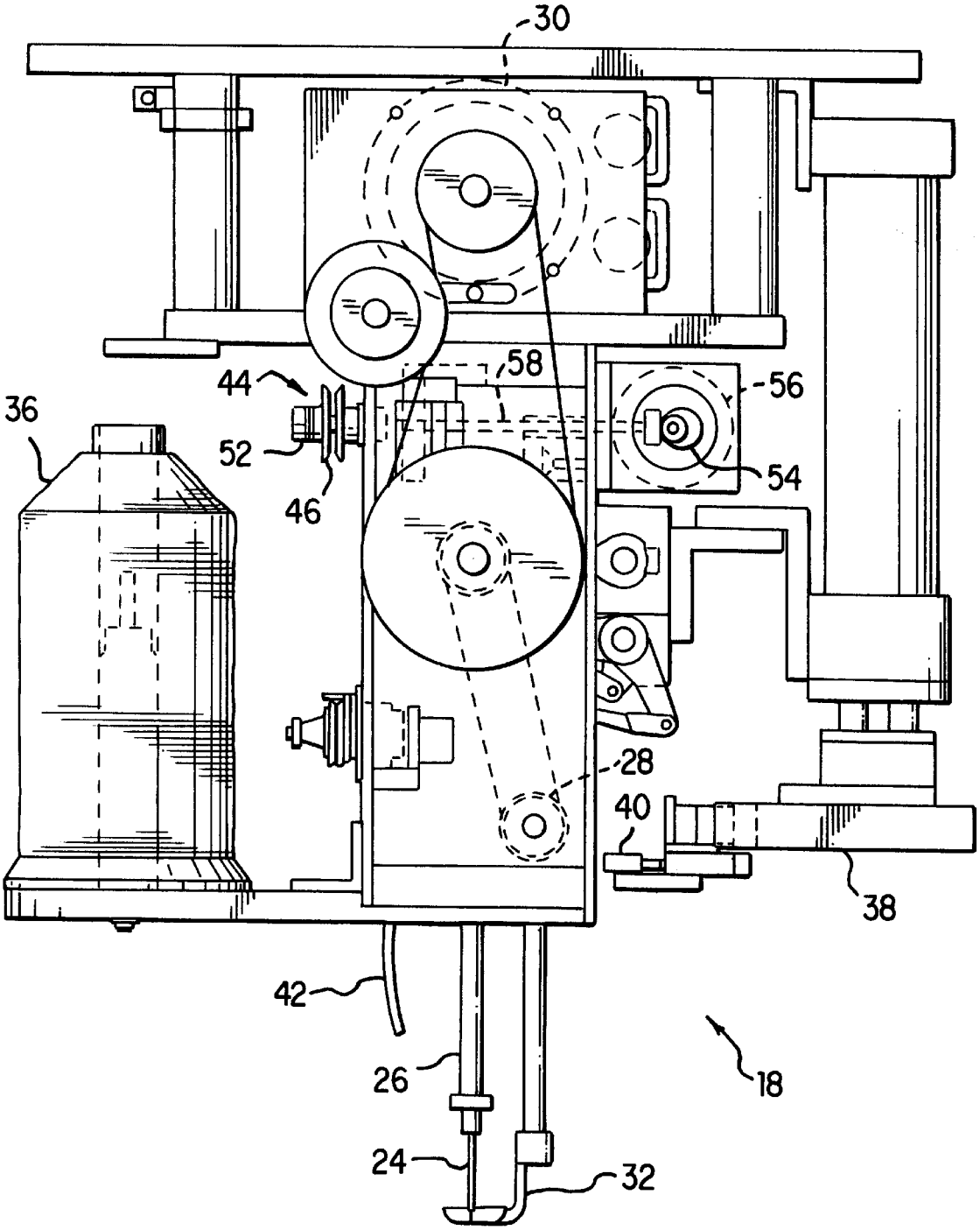
FIG. 3 is a side view of the stitching head.
Figure 4:
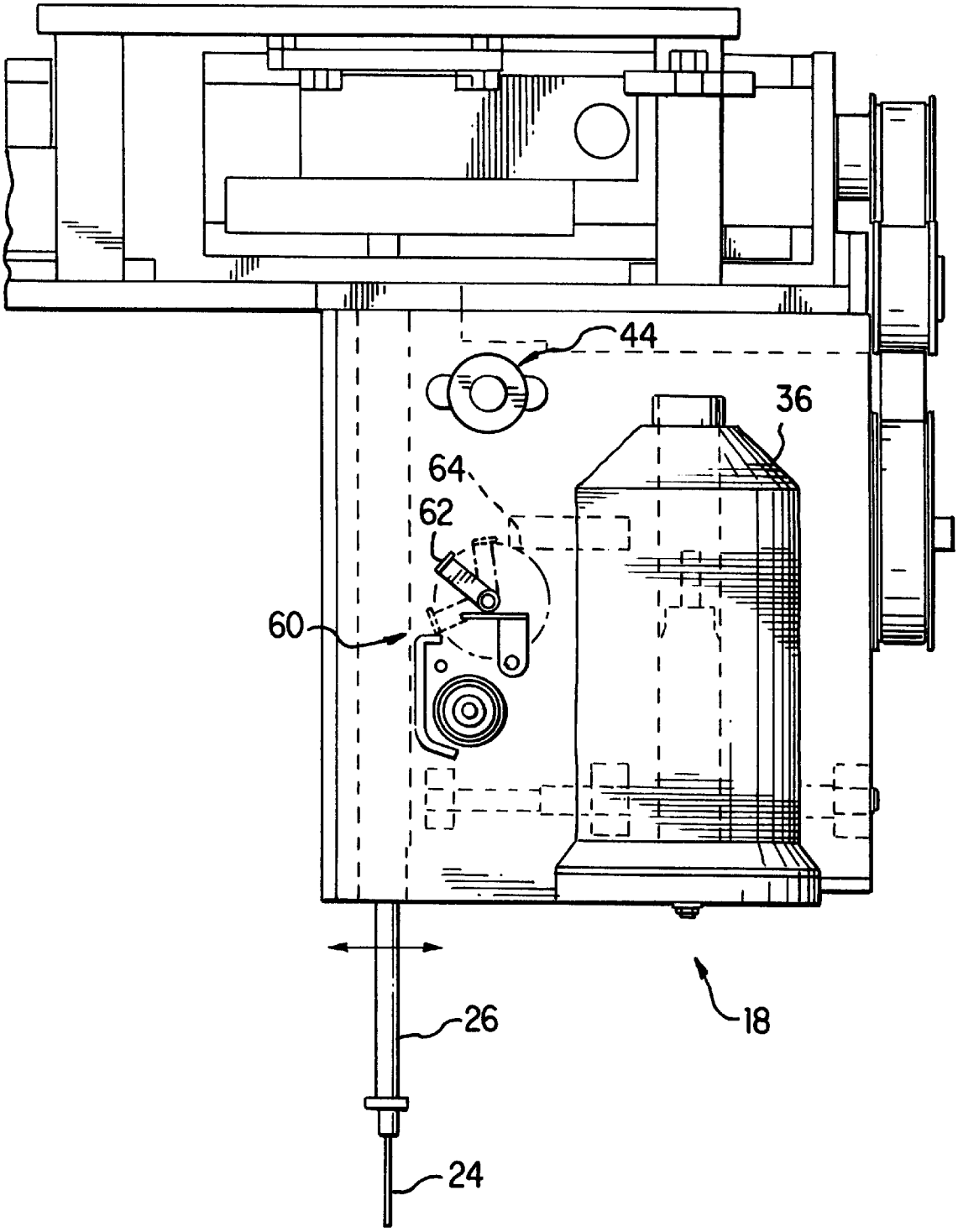
FIG. 4 is a different side view of the stitching head.

FIGS. 2, 3 and 4 show the stitching head 18 in greater detail. The stitching head 18 includes a needle 24, a needle bar 26, and a needle drive mechanism 28 such as a slider crank mechanism for vertically extending and rotating the needle bar for positive and negative reciprocation of the needle 24. The needle drive mechanism 28 is driven by a motor 30. A presser foot 32 applies pressure to the preform and guides the needle 24. A constant-velocity mechanism (not shown) allows the needle 24 to move relative to the preform. If the stitching head 18 is being moved relative to the preform at a fixed feedrate, the constant velocity mechanism effectively adjusts the velocity of the needle 24 with respect to the preform, decreasing the relative velocity when stitches are being made in thicker regions and increasing the relative velocity when stitches are being made in thinner regions. The constant velocity mechanism could be a walking needle mechanism including springs that push against the needle 24 in the x- and y-directions. Or, the constant velocity mechanism could be an active control for moving the needle according to a predetermined profile. Constant velocity could even be achieved by providing the needle with flexibility.

Thread 34 is drawn from a spool 36 and threaded through an eye of the needle 24. Under control of the control station 16, the motor group 22 positions the needle 24 over a stitching point on the preform, and the needle 24 is plunged into the preform. The bobbin 20, which is on the underside of the preform, grabs the thread 32 and forms a loop. The needle 24 is withdrawn from the preform and, under control of the control station 16, it is repositioned over the next stitching point. Once again, the needle 24 is plunged into the preform, the bobbin 20 grabs the thread 28, forms another loop, and also locks a stitch. The needle 24 is withdrawn from the preform and moved to the next stitching point. The stitching process is repeated.

In addition to reciprocating the needle 24, the stitching head 18 performs a number of automated functions. The stitching head 18 includes a thread gripper 38 for holding the thread at the start of the stitching process and for facilitating thread-cutting; a thread cutter 40 having a ceramic cutting element for automatically cutting the thread 34; and a needle cooler such as a venturi which expands a stream of pressurized air and a hose 42 for directing the expanded, cooled air onto the needle 24. The thread gripper 38, thread cutter 40 and the needle cooler 42 can all be off-the-shelf components that are provided with servomechanisms for automatic control by the control station 16.

The stitching head 18 also includes a thread tensioning mechanism 44 for automatically adjusting the thread tension. The thread tensioning mechanism 44 includes a pair of tension discs 46 mounted on a shaft 50. A spring 52 biases one tension disc 46 against the other to apply tension to the thread 24. Distance between the discs 46 is controlled by a cam 54, which is rotated by a stepper motor 56. The thread tensioning mechanism 44 also includes a pneumatic cylinder 58 that quickly separates the discs 46 to release thread tension.

The thread tensioning mechanism 44 can be operated in a closed loop mode, an open loop or a manual mode. When the thread tensioning mechanism 44 is operated in the closed loop mode, the stepper motor 56 is commanded to move to a position based on a value in a lookup table. The value in the lookup table indicates a thread tension value based on thickness of the preform region being stitched. The thread tension value is compared to a measurement of the thread tension, and an error signal results when the thread tension value does not equal the thread tension measurement. The stepper motor 56 turns the cam 54, changing the distance between the discs 46, until the error signal is nulled.

The thread tension measurement can be derived from a signal generated by a load cell. Positioned in the thread path near the needle 24, the load cell generates a raw signal that is proportional to thread tension at or near the needle 24.

When the thread tensioning mechanism 44 is operated in the open loop mode, the thread tension value is determined from the lookup table, and a stepper motor command corresponding to the thread tension value is determined from another lookup table. The stepper motor 56, in response to the stepper motor command, rotates the cam 54, which changes the distance between the discs 46. The stepper motor 56 stays at the commanded position regardless of the measured tension in the thread 34.

When the thread tensioning mechanism 44 is operated in the manual mode, thread tension is adjusted by hand-turning a screw (not shown) on the discs 46. The pneumatic cylinder 58 can also be operated manually.

The stitching head 18 also includes a mechanism 60 for automatically adjusting thread path geometry. The thread path geometry mechanism 60 includes an arm 62 having a first end pivoted to the stitching head's housing and a second end extending into the thread path. A stepper motor 64 or servo moves the arm 62 to increase or decrease the thread path. The thread path is increased when additional thread is needed for stitching through thicker regions, and the thread path is decreased when less thread is needed for stitching through thinner regions. Although the mechanism 60 is shown as having a pivoting arm 62, another mechanism could have a sliding arm that moves linearly into the path of the thread 34. As with the thread tensioning mechanism 44, the thread path geometry mechanism 60 is table-driven. The stepper motor 64 is commanded move to a position based on a stepper motor count in a lookup table. The stepper motor count in the lookup table corresponds to thread path geometry based on thickness of the preform region being stitched.

Figure 5:
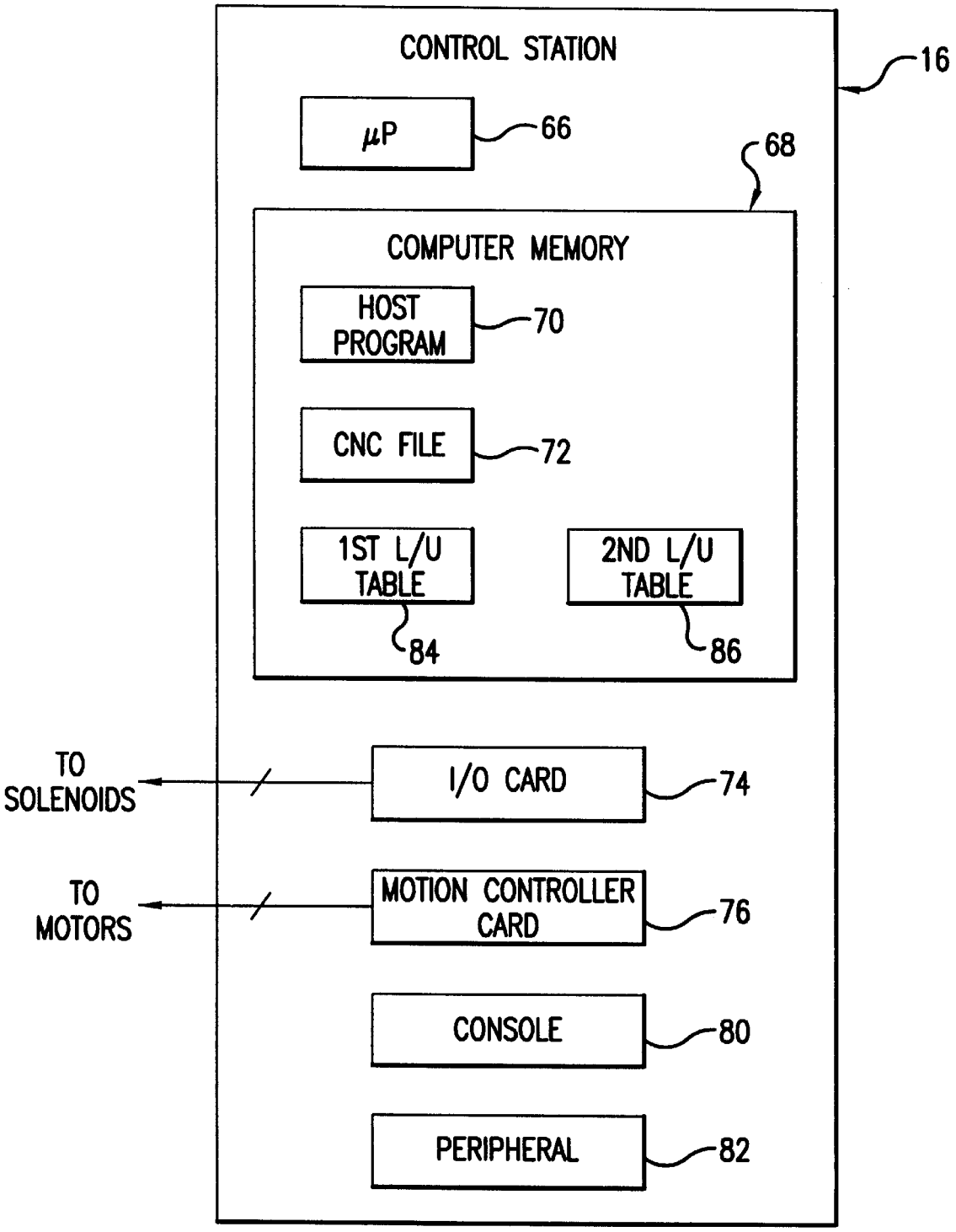
FIG. 5 is a block diagram of the control station.

FIG. 5 shows the control station 16 in greater detail. The control station 16 includes a processor 66 and computer memory 68. Encoded in the computer memory 68 is a host program 70 and a file 72 including instructions for making the stitches, instructions for controlling stitching speed, and instructions for retracting and extending the stitching head 18 to and from the preform. The file 72 also includes instructions for commanding the unique functions of the stitching head 18 such as cooling the needle 24, gripping the thread 34, and cutting the thread 34. The instructions can be based on an EIA RS-274 format, which is a standard for the machine tool industry.

The file 72 further includes instructions indicating a value for thickness of the preform. The instructions indicating the preform thickness values are processed by the control station 16 as described below to generate commands for adjusting the thread path geometry and the thread tension.

The processor 66 executes the host program 70, which instructs the processor 66 to fetch the instructions from the file 72. When an instruction is fetched, the processor 66 generates a command that is sent to an I/O card 74 or a motion controller card 76. When the I/O card 74 receives a command it generates a control signal having an appropriate voltage level for an actuator such as solenoid. When the motion controller card 76 receives a command, it generates a control signal having a appropriate voltage level for an actuator such as a stepper motor. For example, the processor 66 fetches an instruction for making a stitch, and sends position commands to the motion controller card 76. The motion controller card 76 sends control signals to the stepper or servo motors of the motor group 22. Or, the processor 66 fetches an instruction for turning on needle cooling, and sends a command to the I/O card 74, which generates a control signal that opens an air supply valve.

The control station 16 further includes an operator console 80 including a display and keyboard for controlling the stitching machine 14, viewing stitching data, and viewing status and health of the stitching machine 14. A peripheral device 82 such as a floppy disk drive, CD ROM drive or tape drive allows the host program 70 and the file 72 to be loaded into the computer memory 68. In the alternative, the host program 70, and the file 72 could be downloaded from a network. The file 72 could even be entered from the operator console 80.

The processor 66 processes an instruction indicating the preform thickness value by accessing a first lookup table 84 to determine proper tension for the corresponding preform thickness value. Then the processor 66 accesses a second lookup table 86 to determine the corresponding stepper motor count for the proper tension. If the processor 66 finds an exact match for thread tension in the second lookup table 86, it uses the corresponding stepper motor count. If no match is found, the processor 66 uses the closest values for thread tension and interpolates a count for the stepper motor 58 of the thread tensioning mechanism 44.

The processor 66 also accesses the first lookup table 84 to determine a count for the stepper motor 64 of the thread path geometry mechanism 60.

The first and second lookup tables 84 and 86 are stored in the computer memory 68. Exemplary entries for the first and second lookup tables 84 and 86 are shown in Tables 1 and 2. Preform thickness values are indicated by a stack count.

TABLE 1

| Stack Count | Thread Tension | Thread Path Geometry Motor Count |
|---|---|---|
| 1 | 75 g | 230 |
| 2 | 85 g | 300 |

TABLE 2

| Thread Tension | Thread Tension Motor Count |
|---|---|
| 75 g | 300 |
| 90 g | 375 |

Figure 6:
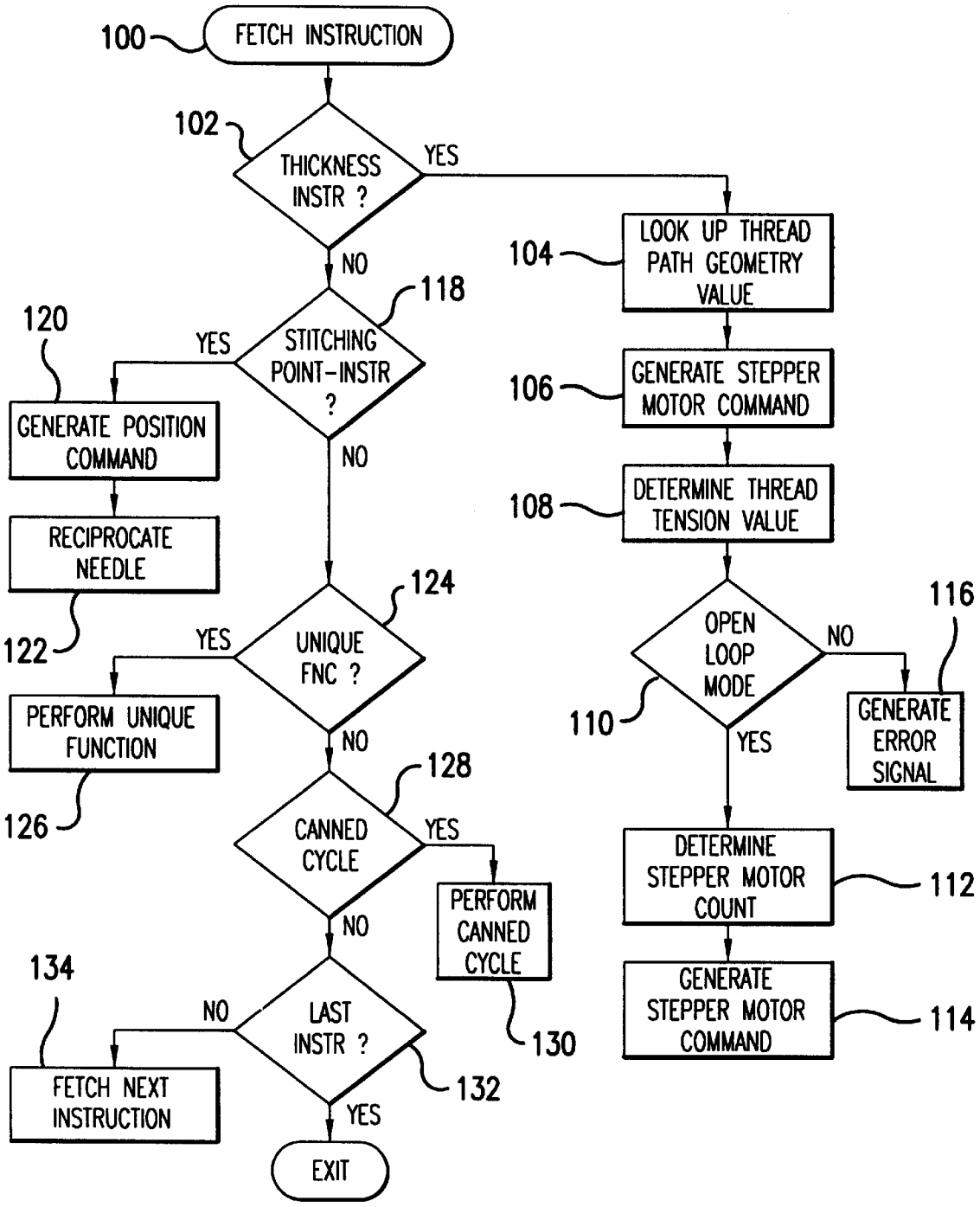
FIG. 6 is a flowchart of a method of operating the stitching head.

FIG. 6 shows a method of operating the stitching head 18. The host program 70 is executed and begins to instruct the processor 66 to access the file 72 and fetch instructions (step 100). When an instruction indicating a preform thickness value is fetched (step 102), the processor 66 automatically adjusts the thread tension and thread path geometry in the stitching head 18. The processor 66 accesses the first lookup table 84 to determine the corresponding count for the stepper motor 64 of the thread path geometry mechanism 60 (step 104). The motion control card 76 generates a stepper motor command (step 106), which causes the stepper motor 64 of the thread path geometry mechanism 60 to move to the stepper motor count.

The processor 66 also looks up a thread tension value in the first lookup table 84 (step 108). If the open loop mode is commanded (step 110), the processor 66 accesses the second lookup table 86 to determine the corresponding stepper motor count for the stepper motor 56 of the thread tensioning mechanism 44 (step 112). The motion control card 76 generates a stepper motor command (step 114), which causes the stepper motor 56 of the thread tensioning mechanism 44 to move to the stepper motor count.

If the closed loop mode is commanded (step 110), the processor 48 does not access the second lookup table 86 but instead generates an error signal indicating a difference between the thread tension measurement and the thread tension value from the first lookup table 84 (step 116). The error signal is used to drive the stepper motor 56 of the thread tensioning mechanism 44 until the thread tension measurement and the thread tension value are about the same.

When an instruction for making a stitch at a stitching point is fetched (step 118), the motion controller card 76 generates position commands for moving the stitching head 18 to the x- and y-coordinates indicated in the stitching instruction (step 120). The position commands cause the motor group 22 to position the stitching head 18 over the stitching point. Once the stitching head 18 is positioned over the stitching point, the processor 66 generates a command that causes the needle drive mechanism 28 to reciprocate the needle 24 (step 122).

When an instruction for performing a unique function of the stitching machine is fetched (step 124), the processor 66 commands the stitching head 18 to perform the unique function (step 126). For example, the processor 66 fetches a command for cooling the needle 24. The I/O card 74, in response to the needle cooling instruction, sends a control signal commanding a valve to supply air to a venturi. Cooled air flows from the venturi, through the hose 42, to the needle 24.

The file 72 can also include instructions for performing "canned cycles." In the alternative, a canned cycle might be commanded from the operator console 80. If a canned cycle is instructed from the file 72 or commanded from the operator console 80 (step 128), the processor 66 performs the canned cycle (step 130).

There might be a canned cycle for starting a stitch. The stitching head 18 is commanded to use a low thread tension for making a few stitches initial stitches. Once the low-tension stitches have been made and the bobbin thread is locked, the stitching head 18 is commanded to increase tension and pull the needle 24 up through the preform. Then, the stitching head 18 is commanded to back off to the proper thread tension for the subsequent stitches.

There might also be a canned cycle for gripping and cutting thread 34. Thread tension is released and the needle bar 26 is retracted to create a thread tail. Then thread tension is turned back on and the thread gripper 38 is opened and extended. The thread gripper 38 grips the thread 34, and the thread cutter 40 heats up and cuts the thread 34 Tension is turned off, and the needle bar 26 is lowered.

The processor 66 fetches additional instructions until the last instruction in the file 72 is accessed (steps 132 and 134).

Figure 7:
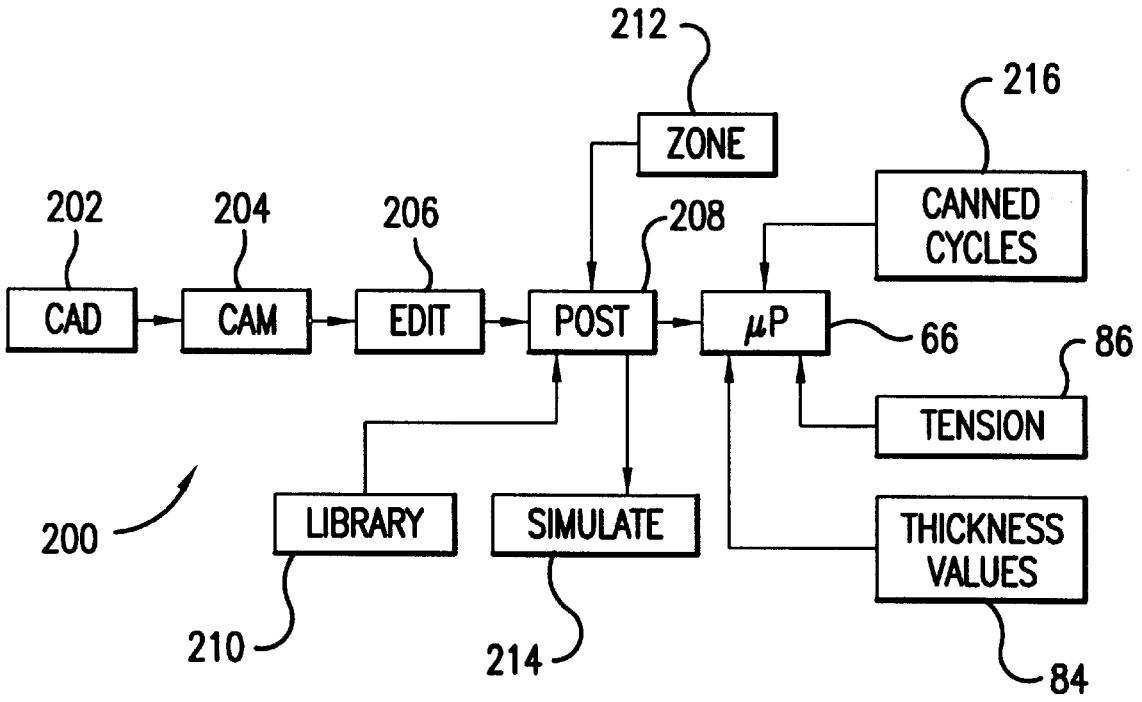
FIG. 7 is diagram of a software architecture for generating code for the stitching system.

FIG. 7 shows the software architecture 200 for generating native code for stitching the preform. A geometric model of the preform (e.g., a loft surface of a wing cover) is generated by CAD software 202. The geometric model, which defines the surface geometry of the preform, is stored in a neutral file format such as "IGES," "STEP PDS" or "DXF." Such CAD software 202 is commercially available. In the alterative, the geometric model could be a mathematical model such as a series of polynomials describing the surface of the preform. However, the neutral file format allows the file of the geometric model to be processed by commercially available CAM software 204.

Tool paths for the model are generated by the CAM software 204. Each tool path includes instructions for making the stitching points. The instructions are generated according to a standard format such as ANSI X3.37 for Cutting Line Source data. At least one instruction is generated for each stitching point.

Additional instructions are manually inserted into the tool paths, between the instructions for making the stitches. Programmers use an editor 206 to manually edit the tool paths and insert instructions for retracting and extending the stitching head 18 and instructions for turning the stitching on and off. The programmers add these additional instructions by working off the geometric model of the preform, identifying constraints on the tool paths, and inserting the appropriate instructions such that the constraints are not violated. For example, a programmer would trace the stitching instructions on a tool path to a stringer, insert an instruction for retracting the stitching head 18 so as not to hit the stringer, and insert an instruction for extending the stitching head 18 on a trailing side of the stringer after the stitching head 18 clears the stringer. Working off the geometric model of the preform, the programmers also manually insert instructions for cutting and gripping the thread 34. Instead of cutting the thread 34, the programmer might decide to drag the thread 34.

After the additional instructions have been added to the tool paths, the tool paths are supplied to a post-processor 208. The post-processor 208 converts the instructions in the ANSI X3.37 format to native code that is readable by the stitching machine 14. Accessing a user-defined library 210, the post-processor 208 converts user-defined instructions (e.g., needle cooling) into native code. The native code could adhere to an EIA RS-274 standard.

The post-processor 208 also generates the instructions indicating part thickness values and inserts the instructions into the tool paths. Going down the tool paths and examining the instructions for making stitches, the post-processor 208 accesses a zone table 212 to determine the preform thickness value corresponding to each stitching point and whether the preform thickness value changes between consecutive stitching points. If the preform thickness value changes, the post processor 208 inserts an instruction indicating the new preform thickness value between the two instructions for making stitches at the consecutive stitching points.

Knowing the preform thickness value at each stitching point, the post-processor 208 also uses the zone table 212 to generate instructions for setting stitching speed and turning needle cooling on and off.

Figure 8:
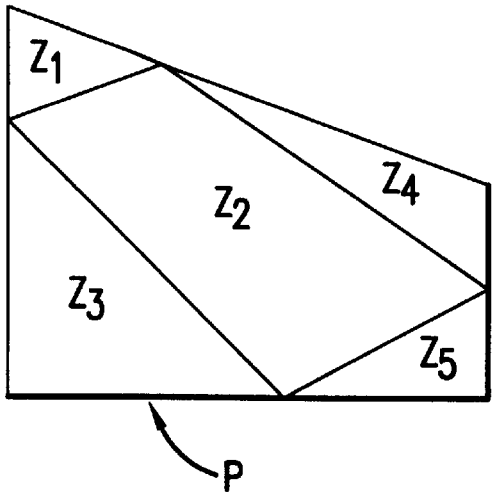
FIG. 8 is a schematic diagram of a preform having variable thickness.

An exemplary zone table is shown in Table 3, and an exemplary preform P is shown in FIG. 8. The preform P is divided into a plurality of zones z1 to zn. Each zone zn has a corresponding preform thickness value such as a stack count. Moreover, each zone z1 to zn is defined by three or four points, allowing for the preform thickness value to be determined quickly.

TABLE 3

| Zone | Stack Count | Speed | Needle Cooling |
|---|---|---|---|
| z1 | 2 | XX | off |
| z2 | 5 | XX | off |

Thus, using the zone table 218, the post-processor 208 can quickly determine the preform thickness value, stitching speed and needle cooling condition of a stitching point lying in one of the zones z1 to zn.

After the native code has been generated, it is tested in a simulation module 214. Simulation ensures that the stitching machine 14 functions properly, the stitching heads 18 do not crash into the material support table 12, the stitching heads 18 do not crash into stringers and violate other constraints, etc.

After the native code has been successfully simulated and debugged, a file 72 containing the native code is loaded into the control station 16. While the file 72 is being executed, the processor 66 accesses the first and second lookup tables 84 and 86 to determine thread tension and stepper motor counts for thread path geometry. The processor 66 also accesses any canned cycle 216 that might be called.

Figure 9:
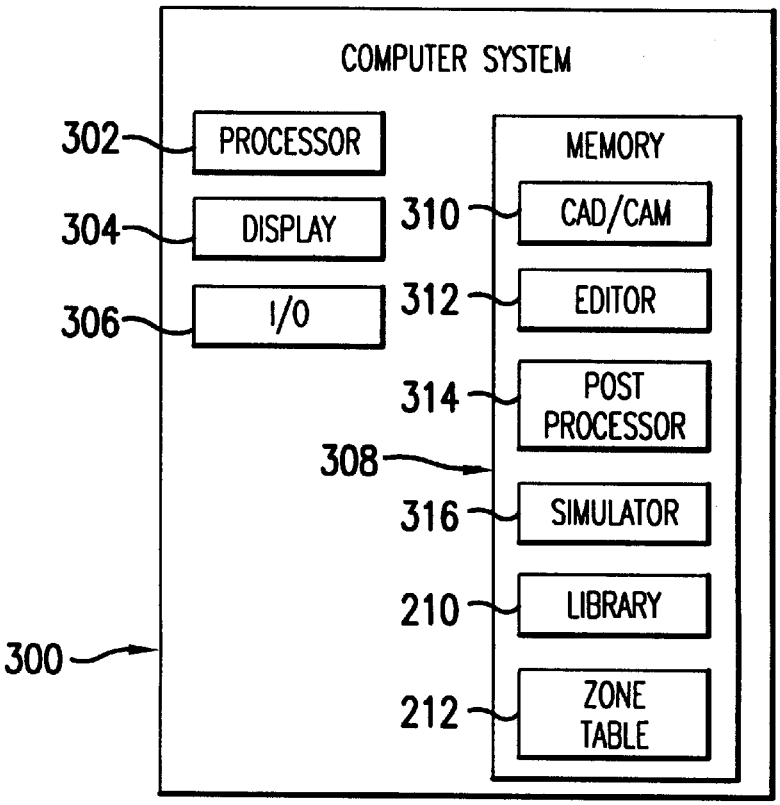
FIG. 9 is a block diagram of a computer system for generating the code.

FIG. 9 shows a computer system 300 for generating the native code. The computer system 300 includes a processor 302, a display 304, I/O devices 306 and memory 308. The memory 308 stores the commercially available CAD/CAM software 310, an editor 312 for inserting the additional instructions into the tool paths, post processing software 314, and a simulator program 316. The memory 308 also includes the user-defined library 210 and the zone table 212. The computer system 300 could be a personal computer, a workstation or a mainframe.

Thus disclosed is an invention that makes stitches in variable-thickness, fiber composite preforms with little to no operator intervention. The invention automatically adjusts thread tension, thread path geometry and stitching speed for variations in the thickness of the preform. No longer must an operator stop the stitching and adjust thread tension or thread path geometry. The stitching head can make stitches in a fiber composite material having a variable thickness between 0 to 1.5 inches. Such variable thickness preforms can be stitched quickly, cost-effectively and precisely.

Changes and modifications may be made without departing from the spirit and scope of the invention. For example, thickness could be indicated by a parameter other than stack count. The stack count merely provides a convenient reference scheme.

In general, although a preferred embodiment of the present invention has been described in detail hereinabove, it should be clearly understood that many other variations and/or modifications of the basic inventive concepts herein taught which may appear to those skilled in the pertinent art will still fall within the spirit and scope of the present invention, as defined in the appended claims.

I claim:

1. A stitching system comprising:

a stitching machine including a stitching head, the stitching head including a thread tensioning mechanism, the thread tensioning mechanism including a servo for setting thread tension in the stitching head;

a control station including a computer, the computer including computer memory encoded with data for instructing the computer to command the servo to set the thread tension in the stitching head to desired thread tension values, whereby setting the thread tension is data-driven:

wherein the thread tensioning mechanism further includes:

a shaft;

first and second thread tensioning discs mounted on the shaft;

means, secured to a first end of the shaft, for applying a bias force that biases the first disc towards the second disc; and a cam having a cam surface, a second end of the shaft being movable along the cam surface to adjust the bias force;

a pneumatic cylinder operative on the first and second discs for releasing thread tension; and, wherein the servo includes a stepper motor for rotating the cam to set the thread tension.

2. The stitching system of claim 1, wherein:

the stitching machine further includes a motor group for positioning the stitching head:

the data includes a first plurality of instructions for instructing the computer to make stitches and a second plurality of instructions for instructing the computer to set the thread tension values, the computer commanding the motor group to move the stitching head in response to an instruction of the first plurality of instructions, and the computer commanding the servo to set the thread tension in response to an instruction of the second plurality of instructions.

3. The stitching system of claim 2, wherein the computer fetches the instructions from the computer memory and responds to the instructions in the sequence fetched, whereby the computer automatically makes first and second stitches at different thread tensions when the computer sequentially fetches a first instruction for making a first stitch, a second instruction for indicating a new thickness value, and a third instruction for making a second stitch.

4. The stitching system of claim 1, wherein the data includes thickness values and instructions for instructing the computer to determine the thread tension values from the thickness values.

5. The stitching system of claim 4, wherein the data further includes a lookup table including a plurality of thread tension values and a plurality of corresponding thickness values, and wherein the computer determines the thread tension values by accessing the lookup table.

6. The stitching system of claim 5, wherein the servo includes a stepper motor, wherein the data further includes a second lookup table including a plurality of stepper motor counts and a plurality of corresponding thread tension values, and wherein the processor determines the stepper motor count by accessing the second lookup table, whereby the servo is operated in an open loop mode.

7. The stitching system of claim 5, further comprising means for taking thread tension measurements; wherein the computer is instructed to command the servo by generating an error signal from the thread tension values and the thread tension measurements, whereby the servo is operated in a closed loop mode.

8. The stitching system of claim 1, wherein the stitching head further includes a mechanism for adjusting thread path geometry, and wherein the computer memory is further encoded with data for instructing the computer to command the thread path geometry mechanism to desired values, whereby adjusting the thread path geometry is data-driven.

9. Apparatus for automatically adjusting thread tension in a stitching head, the apparatus comprising:

a thread tensioning mechanism including a servo, the servo setting the thread tension in response to servo commands;

a processor;

computer memory encoded with data including instructions for instructing a computer to generate thread tension values based on thickness values;

wherein the servo commands are generated from the thread tension values;

wherein the servo commands are supplied to the servo; and, wherein the stitching head includes means for adjusting thread path geometry, the computer memory being further encoded with data including instructions for instructing the computer to generate thread path geometry commands based on the thickness values.

10. The apparatus of claim 9, wherein the data includes instructions indicating the thickness values, and instructions for instructing the processor to determine the thread tension values from the thickness values.

11. The apparatus of claim 10, wherein the data further includes a lookup table including a plurality of thread tension values and a plurality of corresponding thickness values, and wherein the processor determines the thread tension values by accessing the lookup table.

12. The apparatus of claim 9, wherein the servo includes a stepper motor, and wherein stepper motor counts are derived from the thread tension values.

13. The apparatus of claim 12, wherein the data further includes a second lookup table including a plurality of stepper motor counts and a plurality of corresponding thread tension values, and wherein the processor determines the stepper motor count by accessing the second lookup table.

14. A stitching head for stitching a preform made of multiple layers of a variable thickness textile composite, the stitching being performed with a thread made of a composite material, the stitching head comprising:

a needle;

reciprocating means for reciprocating the needle;

a servo-driven thread gripper;

a servo-driven thread cutter;

a servo-driven thread path geometry controller for adjusting an amount of the thread used by the needle during stitching of the preform, adjustment of the amount of thread used during the stitching being based upon thickness of the preform; and, a servo-driven needle cooler, operation of the needle cooler being based upon the thickness of the preform.

15. The stitching head of claim 14, further comprising a servo-driven thread tensioning mechanism, operation of the thread tensioning mechanism being based upon the thickness of the preform.

16. The stitching head of claim 15, wherein the thread tensioning mechanism includes an electromechanical machine for adjusting the thread tension.

17. The stitching head as set forth in claim 14, wherein:

the preform has a compound, contoured, three-dimensional surface; and, the servo-driven thread path geometry controller automatically moves the stitching head to successive stitching positions in accordance with a path geometry control program.

18. The stitching head as set forth in claim 14, further comprising a needle speed servo controller for controlling the speed at which the needle is reciprocated by the reciprocating means based upon the thickness of the preform.

19. The stitching head as set forth in claim 14, further comprising:

a thread tension measurement means for taking measurements of the thread tension at each of a plurality of successive stitching positions; and, a thread tension servo controller that controllably varies the thread tension based upon the thread tension measurement taken at each of the successive stitching positions in order to achieve a desired thread tension value derived by a computer program based upon the thickness of the preform at each of the successive stitching positions.

20. The stitching head as set forth in claim 19, wherein:

the thread tension servo controller includes a stepper motor and a cam rotated by the stepper motor to adjust the thread tension;

the thread tension servo controller is responsive to a stepper motor count value derived by a computer program based upon the thickness of the preform at each of the successive stitching positions to control the stepper motor to rotate the cam by a prescribed amount that is related to the desired thread tension value at each of the successive stitching positions.

* * * * *